US007211939B2

(12) United States Patent
Lim

(10) Patent No.: US 7,211,939 B2
(45) Date of Patent: May 1, 2007

(54) EXTERNAL ELECTRODE FLUORESCENT LAMP AND METHOD FOR MANUFACTURING THE SAME

(75) Inventor: Moo Jong Lim, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 263 days.

(21) Appl. No.: 10/742,929

(22) Filed: Dec. 23, 2003

(65) Prior Publication Data

US 2004/0135484 A1 Jul. 15, 2004

(30) Foreign Application Priority Data

Dec. 31, 2002 (KR) ..... 10-2002-0087810

(51) Int. Cl.
*H01J 11/02* (2006.01)

(52) U.S. Cl. ..... 313/234; 313/607; 313/318.02; 313/318.03

(58) Field of Classification Search ..... 313/234, 313/607; 445/46, 52
See application file for complete search history.

(56) References Cited

U.S. PATENT DOCUMENTS 5,013,966 A * 5/1991 Saikatsu et al. ..... 313/493
5,541,475 A * 7/1996 Wood et al. ..... 313/484
2001/0033483 A1* 10/2001 Moore ..... 362/84

FOREIGN PATENT DOCUMENTS

JP 2004079268 A * 3/2004
KR 2002040734 A * 5/2002

* cited by examiner

*Primary Examiner*—Mariceli Santiago
*Assistant Examiner*—Matt Hodges
(74) *Attorney, Agent, or Firm*—McKenna Long & Aldridge LLP

(57) ABSTRACT

An external electrode fluorescent lamp and a method for manufacturing the same is disclosed, in which indentations are provided in a surface of a glass tube filled with a discharge gas by etching, and external electrodes are formed at both ends of the glass tube, thereby realizing close adhesion between external electrode and the glass tube.

21 Claims, 3 Drawing Sheets

EXTERNAL ELECTRODE FLUORESCENT LAMP AND METHOD FOR MANUFACTURING THE SAME

This application claims the benefit of the Korean Application No. P2002-87810 filed on Dec. 31, 2002, which is hereby incorporated by reference.

BACKGROUND OF THE INVENTION

1. Field of the Invention

The present invention relates to an external electrode fluorescent lamp EEFL for a backlight, and more particularly, to an external electrode fluorescent lamp and a method for manufacturing the same, in which indentations are provided in a surface of a glass tube by etching when forming external electrodes at both ends of a fluorescent lamp.

2. Discussion of the Related Art

A Cathode Ray Tube (CRT) has been widely used as monitors in televisions, measuring machines, and information terminals. However, the CRT has limitations in size and weight. Accordingly, display devices such as liquid crystal display (LCD) devices using an electro-optics effect, plasma display panels (PDP) using gas discharge, and an electro luminescence display (ELD) devices using an electro-luminescence effect have been developed to replace the CRT.

LCD devices have been studied because LCD devices have great picture quality, low power consumption, and low heat dissipation as compared to CRTs. However, an LCD device does not emit light by itself, so that it is necessary to provide an additional light source. One solution is a reflecting-type LCD device using ambient light as a light source, but this has limitations in practical use due to the environment. In response, a transmitting-type LCD device having an additional light source has been developed, in which the additional light source is referred to as a backlight. An LCD device may use one of various light sources such as electro luminescence (EL), a light emitting diode (LED), a cold cathode fluorescent lamp (CCFL), or a hot cathode fluorescent lamp (HCFL). The CCFL having a long lifetime, low power consumption, and a thin profile is generally used for the light source.

In transmitting-type LCD devices, the backlight may be classified into a direct-type method and an edge-type method depending on the position of a fluorescent lamp. In the edge-type backlight, a tube-type fluorescent lamp is positioned at a side of the LCD panel, for transmitting the light from the fluorescent lamp to the entire surface of the LCD panel with a transparent light-guiding plate. Meanwhile, the direct-type backlight has been more widely used with large-sized LCD devices of 20-inch or more, in which a plurality of fluorescent lamps are placed below a lower surface of a light-diffusion plate, whereby the entire surface of the LCD panel is directly illuminated by the fluorescent lamps. At this time, the direct-type method, which has greater luminous efficiency as compared with that of the edge-type method, is used for large-sized LCD devices requiring high luminance. For example, the LCD device of the direct-type method is generally used for large-sized monitors or the televisions.

Hereinafter, a backlight for an LCD device according to the related art will be described with reference to the accompanying drawings.

FIG. 1 is a perspective view schematically illustrating a direct-type backlight according to the related art, and FIG. 2 illustrates a fluorescent lamp according to the related art.

As shown in FIG. 1, the direct-type backlight according to the related art includes a plurality of fluorescent lamps 1, an outer case 3, and light diffuser 5. In this example, the plurality of fluorescent lamps 1 are positioned along one direction at fixed intervals, and the outer case 3 maintains and supports the plurality of fluorescent lamps 1 at fixed intervals. Then, the light diffuser 5 is positioned above the plurality of fluorescent lamps 1. The light diffuser 5 prevents the silhouette of the fluorescent lamps 1 from being displayed on the display surface of the LCD panel (not shown), and for providing a light source having uniform luminance. For improving efficiency in diffusing light, a plurality of diffusion sheets and diffusion plates 5*a*, 5*b*, 5*c* may be provided. Also, a reflecting plate 7 is provided on an inner surface of the outer case 3 to concentrate the light emitted from the fluorescent lamps 1 to the display surface of the LCD panel, thereby improving the luminous efficiency. Also each fluorescent lamp 1 is fixed to holes provided at both sides of the outer case 3.

As shown in FIG. 2, the CCFL 1 is filled with a discharge gas, and electrodes 2 and 2*a* are provided, one electrode of a glass tube for applying power (not shown). Also, wires 9 are connected to the electrodes 2 and 2*a*. The wires 9 are also connected to an inverter (not shown) and a driving circuit. Each fluorescent lamp 1 requires an individual inverter.

However, the direct-type backlight according to the related art has the following disadvantages. In the direct-type backlight according to the related art, the silhouette of the CCFL may be displayed on the display surface of the LCD panel. Therefore, it is necessary to maintain a predetermined distance between the LCD panel and the CCFL. When using the direct-type backlight according to the related art, there are limitations as to how thin the LCD device may be. Also, hot cathode or cold cathode type electrodes are provided at the both ends of the glass tube in the related art fluorescent lamp. However, the process for providing the electrodes inside the fluorescent lamp is complicated, and each fluorescent lamp is driven with an individual inverter, thereby increasing manufacturing cost and the lifetime of the fluorescent lamp.

SUMMARY OF THE INVENTION

Accordingly, the present invention is directed to an external electrode fluorescent lamp and a method for manufacturing the same that substantially obviates one or more problems due to limitations and disadvantages of the related art.

An advantage of the present invention is to provide an external electrode fluorescent lamp and a method for manufacturing the same, wherein external electrodes are provided at both ends of a glass tube for a fluorescent lamp, thereby obtaining a long lifetime of the fluorescent lamp, and simplified manufacturing process steps.

Another advantage of the present invention is to provide an external electrode fluorescent lamp and a method for manufacturing the same, wherein indentations are provided in a surface of a glass tube by etching, thereby realizing close adhesion between an external electrode and the glass tube.

Additional objects and features of the invention will be set forth in part in the description which follows and in part will become apparent to those having ordinary skill in the art upon examination of the following or may be learned from practice of the invention. The advantages of the invention may be realized and attained by the structure particularly pointed out in the written description and claims hereof as well as the appended drawings.

To achieve these advantages and in accordance with the purpose of the invention, as embodied and broadly described herein, an external electrode fluorescent lamp includes a glass tube filled with a discharge gas, wherein the glass tube has plurality of indentations in a surface thereof; and external electrodes at both ends of the glass tube.

Also, the external electrode fluorescent lamp further includes an electrode connection wire being connected to each external electrode, for applying an external power thereto; and an insulator surrounding the external electrode and the electrode connection wire for a complete connection therebetween.

In another aspect, a method for manufacturing an external electrode fluorescent lamp includes preparing a glass tube filled with a discharge gas; forming indentations in a glass tube filled with a discharge gas by selectively etching a surface of the glass tube up to about 30% of an entire thickness of the glass tube at both ends of the glass tube; and forming external electrodes at both ends of the glass tube having the indentations.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, an external electrode fluorescent lamp according to the present invention and a method for manufacturing the same will be described with reference to the accompanying drawings.

Figure 1:
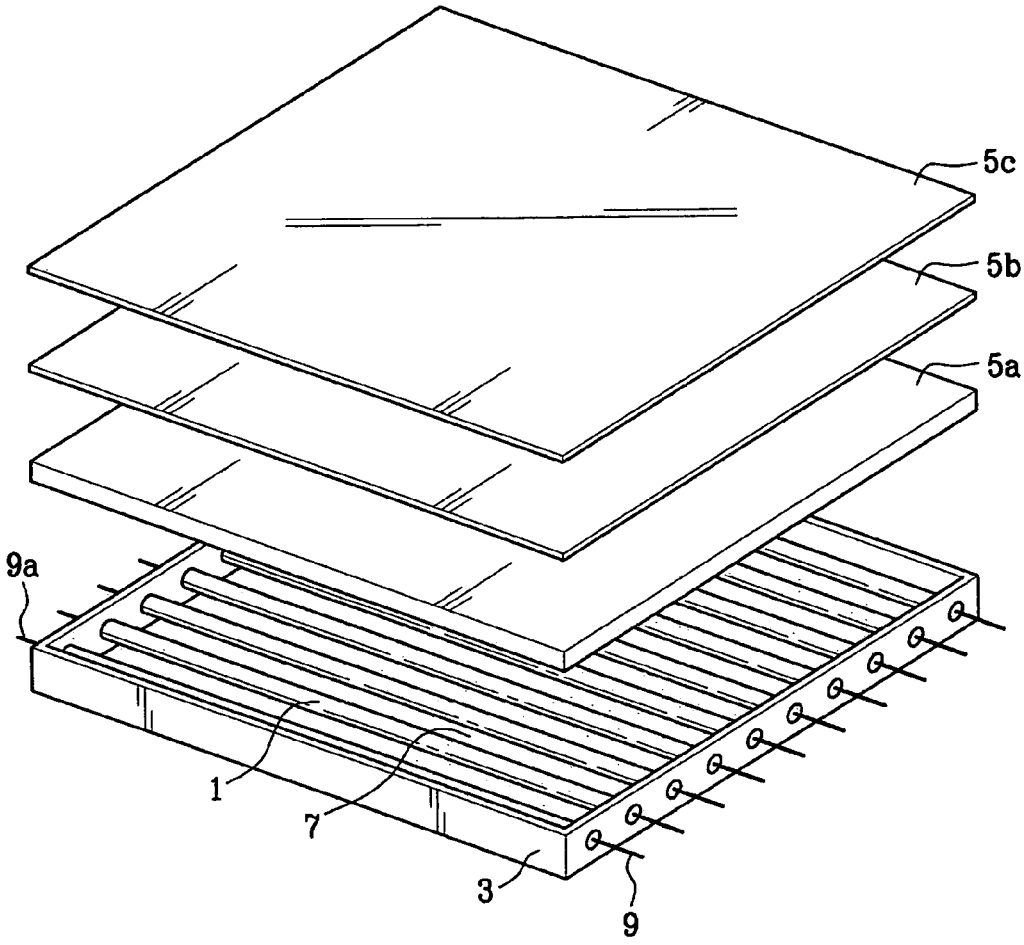
FIG. 1 Related Art
FIG. 1 is a perspective view schematically illustrating a direct-type backlight according to the related art.
Figure 2:
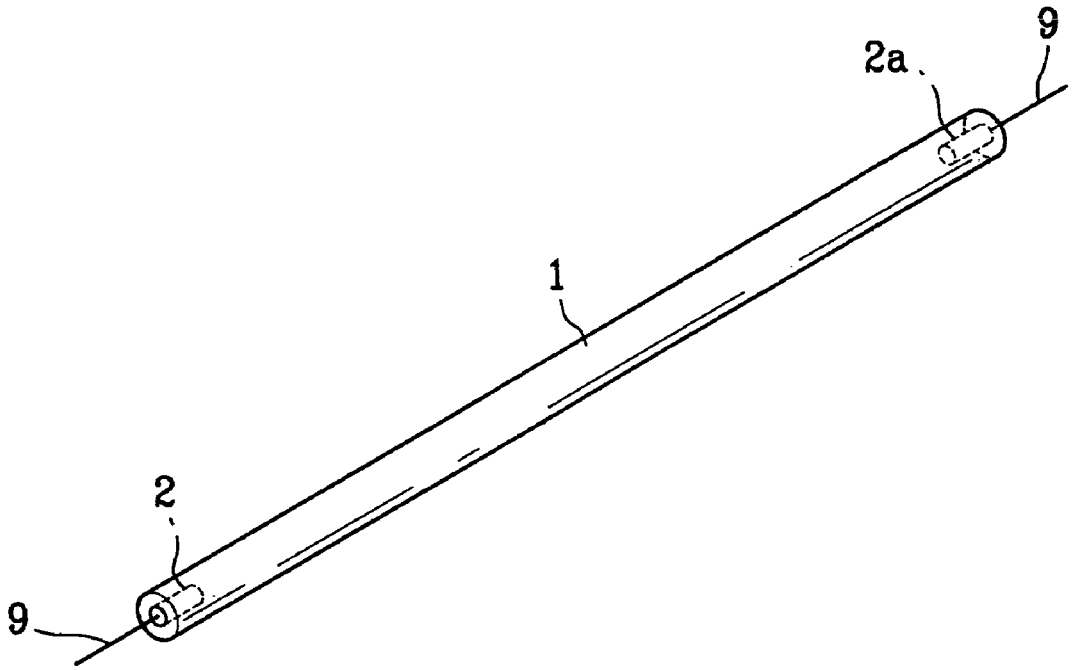
FIG. 2 Related Art
FIG. 2 illustrates a fluorescent lamp according to the related art.
Figure 3:
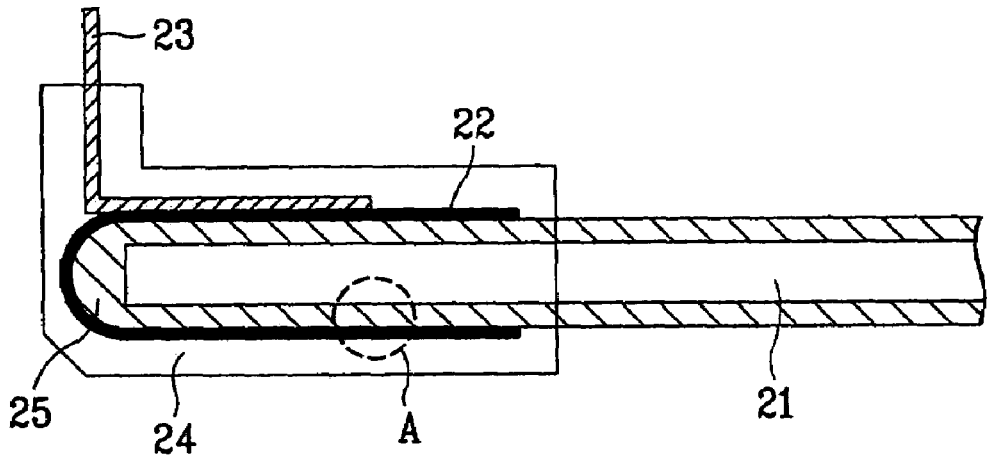
FIG. 3 is a cross-sectional view illustrating an external electrode fluorescent lamp according to the present invention.
Figure 4:
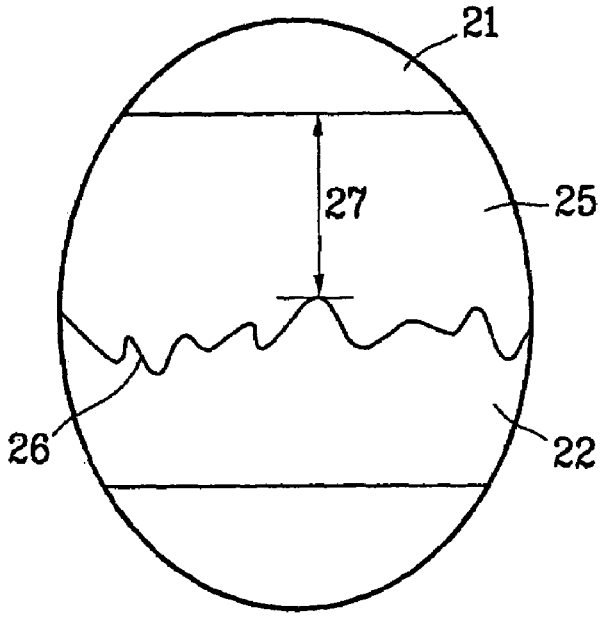
FIG. 4 is an expanded cross-sectional view of "A" portion in FIG. 3.

FIG. 3 is a cross-sectional view illustrating an external electrode fluorescent lamp according to the present invention; and FIG. 4 is an expanded cross-sectional view of a portion denoted "A" in FIG. 3.

As shown in FIG. 3, in the external electrode fluorescent lamp according to the present invention, a glass tube 25 is filled with a discharge gas 21, and external electrodes 22 are provided at both ends of the glass tube 25 to apply an electric field to the discharge gas 21. An electrode connection wire 23 is connected to each external electrode 22 to apply power (not shown).

To completely and securely connect the electrode connection wire 23 to the external electrode 22, an insulator 24 surrounds the external electrode 22 and the electrode connection wire 23, together. The insulator 24 is formed of a contracting tube resulting in a complete connection and close adhesion between the external electrode 22 and the electrode connection wire 23 when heated. Further, as shown in FIG. 4, an uneven surface having a plurality of indentations 26 is formed in a surface of the glass tube 25 corresponding to the external electrode 22 for realizing complete adhesion between the external electrode 22 and the glass tube 25.

More specifically, a method of manufacturing the external electrode of the external electrode fluorescent lamp will be described in detail.

First, the glass tube 25 is filled with the discharge gas 21. Then, the glass tube 25 is selectively etched to form the indentations 26 in predetermined portions at both ends of the glass tube 25, whereby the irregular indentations 26 are formed in the surface of the glass tube 25. After that, the external electrodes 22 are formed at both ends of the glass tube 25 having the irregular indentations 26.

Herein, the method for forming the external electrode on the glass tube 25 having the indentations 26 may be classified into plating and sintering methods.

In the plating method, the external electrode 22 is formed of a metal material such as nickel Ni. In this method, before forming the external electrode 22, a physical and chemical etching process is performed on the surface of the glass tube 25 to improve adhesion efficiency. Then, the external surfaces of both ends of the glass tube 25 having the indentations 26 are thinly plated with a metal material such as an non-electrolytic nickel, thereby forming the external electrodes 22 at the both ends of the glass tube 25. The irregular indentations 26 are formed in the external surfaces at both ends of the glass tube 25 by etching, so that the external electrodes 22 adhere to the glass tube 25, completely and easily. Then, each external electrode 22 is electrically connected to the electrode connection wire 23, and a voltage applied to the electrode connection wire 23 passes through the external electrode 22 of the fluorescent lamp, thereby generating the electric field inside the fluorescent lamp. According to the aforementioned process, the fluorescent lamp emits the light.

In the sintering method, powdered metal such as Ag is dispersed in a thermoplastic binder (not shown), thereby making a melting conductive paste. Then, the melting conductive paste is injected into a socket (not shown) in a small amount, where the socket forms the external electrode 22. Subsequently, after dipping the glass tube having the indentations 26 into the socket (not shown) containing the conductive paste, the glass tube is heated to a high temperature to form the external electrode 22. At this time, the appropriate temperature may vary according to the kind of the conductive paste. In case of a fluorescent lamp, it is preferable to maintain the glass tube at a temperature of 150° C. In the sintering method for the external electrode 22, the external electrode 22 is formed of the conductive paste such as Ag. Also, like the plating method, the sintering method performs the physical and chemical etching process on the surface of the glass tube to improve the adhesion efficiency before forming the external electrode 22.

In addition to the plating and sintering methods, various methods may be used for forming the external electrode of the fluorescent lamp. For example, a taping method may be used, in which the external electrode is formed of Al or Cu tape. Or, the external electrode 22 may be formed using a method of covering both ends of the glass tube 25 with metal capsules (not shown).

Among the methods for forming the external electrode 22, the aforementioned method for forming the external electrode 22 by etching the surface of the glass tube 25 results in great adhesion between the glass tube 25 and the external electrode 22 because the plurality of indentations 26 are formed in the surface of the glass tube 25 by etching.

When forming the indentations 26 in the surface of the glass tube 25, if a predetermined portion of the glass tube 25 is etched excessively, it may result in a pinhole in the surface of the glass tube 25 when applying a high voltage to the external electrode 22. Accordingly, in the case of forming the indentations 26 in the surface of the glass tube 25 by etching, the depth of each indentation 26 is about 30% or less of the thickness of the glass tube 25. That is, after completing the etching process, the thickness of the glass tube 27 after forming the indentations is at 70% or more of an initial thickness thereof. By controlling the etching thickness, it is possible to have complete adhesion between the glass tube 25 and the external electrode 22, and to prevent a pinhole from forming in the glass tube 25 when applying a high voltage to the external electrode 22.

As mentioned above, the external electrode fluorescent lamp for the backlight and the method for manufacturing the external electrode according to the present invention have the following advantages.

In the method for forming the external electrode, the indentations are formed in the surface of the glass tube by etching, whereby the external electrode completely adheres to the glass tube. Especially, when etching the surface of the glass tube, the etching depth of the indentation is controlled within a predetermined limit, so that it is possible to prevent a pinhole from forming in the surface of the glass tube when applying a high voltage to the external electrode, thereby realizing a long lifetime of the fluorescent lamp according to the present invention.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An external electrode fluorescent lamp comprising:

a glass tube filled with a discharge gas; and external electrodes on each end of the glass tube, each external electrode on a plurality of indentations having a reduced the wall thickness of the glass tube, wherein each indentation has a different depth.

2. The external electrode fluorescent lamp of claim 1, further comprising:

an electrode connection wire connected to one of the external electrodes that applies power thereto; and an insulator surrounding the external electrode and a portion of the electrode connection wire.

3. An external electrode fluorescent lamp comprising:

a glass tube filled with a discharge gas, wherein the glass tube has plurality of indentations in a surface thereof;

external electrodes at both ends of the glass tube;

an electrode connection wire connected to one of the external electrodes that applies power thereto; and an insulator surrounding the external electrode and a portion of the electrode connection wire, wherein the insulator is formed of a contracting tube.

4. The external electrode fluorescent lamp of claim 1, wherein the depth of the indentations, formed in the surface of the glass tube are about 30% or less of the thickness of the glass tube.

5. The external electrode fluorescent lamp of claim 1, wherein one of the electrodes is made of nickel.

6. The external electrode fluorescent lamp of claim 1, wherein one of the electrodes is made by plating metal on the ends of the tube.

7. An external electrode fluorescent lamp comprising:

a glass tube filled with a discharge gas, wherein the glass tube has plurality of indentations in a surface thereof; and external electrodes at both ends of the glass tube, wherein one of the electrodes is made with one of copper tape or silver tape.

8. The external electrode fluorescent lamp of claim 1, wherein one of the electrodes is made by heating the glass tube and dipping the glass tube in melting conductive paste.

9. The external electrode fluorescent lamp of claim 8, wherein the melting conductive paste includes silver.

10. The external electrode fluorescent lamp of claim 1, wherein one of the electrodes is a cap placed over one end of the glass tube.

11. A method of manufacturing an external electrode fluorescent lamp comprising:

forming indentations in a glass tube filled with a discharge gas by selectively etching a surface of the glass tube up to about 30% of an entire thickness of the glass tube at both ends of the glass tube; and forming external electrodes at both ends of the glass tube having the indentations.

12. The method of claim 11, wherein one of the external electrodes is formed of a metal material such as nickel.

13. The method of claim 11, wherein forming one of the external electrodes includes heating the glass tube to a temperature of 150° C. and dipping the both ends of the glass tube into melting conductive paste.

14. The method of claim 13, wherein the melting conductive paste includes silver.

15. The method of claim 11, wherein forming one of the external electrodes includes plating both ends of the glass tube with a metal material.

16. The method of claim 11, wherein forming one of the external electrodes includes taping one end of the glass tube with metal tape.

17. The method of claim 16, wherein the metal tape is one of copper tape and silver tape.

18. The method of claim 11, wherein forming one of the external electrodes includes placing a metal cap on one end of glass tube.

19. The method of claim 11, including connecting an electrode connection wire to one of the external electrodes.

20. The method of claim 19, including surrounding one of the external electrodes and a portion of the electrode connection wire with an insulator.

21. The method of claim 20, wherein surrounding with the insulator includes using a contracting tube.

* * * * *